US009982952B2

(12) United States Patent
Lavenu et al.

(10) Patent No.: US 9,982,952 B2
(45) Date of Patent: May 29, 2018

(54) HEAT EXCHANGER HEADER

(75) Inventors: Jean Lavenu, Caurel (FR); Lionel Taupin, Cormicy (FR); Alain Bauerheim, Jonchery-sur-Vesle (FR); Laurent Moreau, Reims (FR)

(73) Assignee: VALEO SYSTEMES THERMIQUES, Le Mesnil Saint Denis (FR)

( * ) Notice: Subject to any disclaimer, the term of this patent is extended or adjusted under 35 U.S.C. 154(b) by 682 days.

(21) Appl. No.: 13/503,365

(22) PCT Filed: Oct. 18, 2010

(86) PCT No.: PCT/EP2010/065632

§ 371 (c)(1),
(2), (4) Date: Sep. 17, 2012

(87) PCT Pub. No.: WO2011/048050

PCT Pub. Date: Apr. 28, 2011

(65) Prior Publication Data

US 2013/0000876 A1 Jan. 3, 2013

(30) Foreign Application Priority Data

Oct. 22, 2009 (FR) ..... 09 05069

(51) Int. Cl.
*F28F 9/02* (2006.01)
*F28D 7/06* (2006.01)
(Continued)

(52) U.S. Cl.
CPC ..... *F28F 9/0224* (2013.01); *F28F 9/002* (2013.01); *F28F 9/0248* (2013.01); *F28F 2275/122* (2013.01)

(58) Field of Classification Search
CPC ..... F28F 9/002; F28F 9/0224; F28F 9/0248; F28F 2275/122
(Continued)

(56) References Cited

U.S. PATENT DOCUMENTS 5,183,100 A * 2/1993 Harrell, Jr. ..... F24J 3/084 165/45
5,205,349 A * 4/1993 Nagao ..... B60H 1/00328 165/153
(Continued)

FOREIGN PATENT DOCUMENTS

DE 4232018 A1 * 3/1994
DE 102006040848 A1 3/2007
(Continued)

OTHER PUBLICATIONS

English language abstract and machine-assisted translation for DE 4232018 extracted from the espacenet.com database on Jul. 11, 2012, 20 pages.
(Continued)

*Primary Examiner* — Jason Thompson
(74) *Attorney, Agent, or Firm* — Howard & Howard Attorneys PLLC

(57) ABSTRACT

The present invention relates to a heat exchanger header, wherein said header includes a lower portion (3) having two longitudinal edges (7), an upper portion (4) forming a cover, and at least one flange (9, 10, 30). According to the invention, said flange (9, 10, 30) has a profile (11, 17, 37) that enables the longitudinal edges (7) of the header, which are provided at least locally folded, to be received at the flanks (12, 19, 38) thereof, so as to simultaneously crimp the flange (9, 10, 30) onto said cover (4) and retain the cover (4) on said lower portion (3).

8 Claims, 2 Drawing Sheets

(51) Int. Cl.
*F28D 7/10* (2006.01)
*F28F 9/00* (2006.01)

(58) Field of Classification Search
USPC ..... 165/149, 153, 173, 176
See application file for complete search history.

(56) References Cited

U.S. PATENT DOCUMENTS

| | | | | |
|---|---|---|---|---|
| 5,947,196 | A * | 9/1999 | Halm | F28F 9/002 165/153 |
| 5,950,713 | A * | 9/1999 | Kato | B23K 1/0012 165/76 |
| 6,293,011 | B1 * | 9/2001 | Hasegawa et al. | 29/890.052 |
| 6,595,272 | B1 * | 7/2003 | Uchikawa | B23K 1/0012 165/134.1 |
| 7,007,499 | B1 * | 3/2006 | Patel | 62/298 |
| 7,448,436 | B2 * | 11/2008 | Katoh | F25B 39/02 165/110 |
| 8,011,420 | B2 * | 9/2011 | Mazzocco | F28F 9/002 165/149 |
| 2007/0251682 | A1 * | 11/2007 | Sasaki | 165/153 |
| 2011/0272130 | A1 * | 11/2011 | Yamazaki | 165/185 |
| 2013/0319644 | A1 * | 12/2013 | Moreau et al. | 165/173 |
| 2014/0299301 | A1 * | 10/2014 | Dumoutier | F28F 9/0224 165/173 |
| 2016/0146548 | A1 * | 5/2016 | Durbecq | F28F 9/0224 165/178 |

FOREIGN PATENT DOCUMENTS

| | | | |
|---|---|---|---|
| EP | 1813902 | A1 | 8/2007 |
| EP | 2108909 | A1 | 10/2009 |
| FR | 2791766 | A1 * | 10/2000 |
| FR | 2875897 | A1 | 3/2006 |
| JP | 2004-219025 | A | 8/2004 |
| WO | WO 2005088225 | A1 * | 9/2005 |

OTHER PUBLICATIONS

English language abstract and machine-assisted translation for DE 102006040848 extracted from the espacenet.com database on Jul. 11, 2012, 43 pages.

English language abstract and machine-assisted translation for EP 1813902 extracted from the espacenet.com database on Jul. 11, 2012, 27 pages.

English language abstract and machine-assisted translation for FR 2875897 extracted from the espacenet.com database on Jul. 11, 2012, 29 pages.

English language abstract and machine-assisted translation for JP 2004-219025 extracted from the PAJ database on Jul. 11, 2012, 22 pages.

International Search Report for Application No. PCT/EP2010/065632 dated Feb. 2, 2011, 3 pages.

* cited by examiner

HEAT EXCHANGER HEADER

RELATED APPLICATIONS

This application claims priority to and all the advantages of International Patent Application No. PCT/EP2010/065632, filed on Oct. 18, 2010, which claims priority to French Patent Application No. FR 09/05069, filed on Oct. 22, 2009.

The present invention relates to a header for a heat exchanger and to a heat exchanger equipped with such a header and to an associated method of assembly.

The invention will notably find applications in the field of condensers for motor vehicle heating or cooling devices.

However, although particularly intended for such an application, the exchanger could be used in other fields that employ exchangers comprising headers made in two parts.

BACKGROUND OF THE INVENTION

Certain heat exchangers use a type of header made in two parts, known as a two-part header or a two-part header tank.

More specifically, this type of header comprises a lower first part or collector plate which comprises a bottom and longitudinal walls.

This type of header also comprises an upper part forming a cover, this upper part accepting flanges that form inlets and/or outlets for fluid passing through the exchanger and/or flanges that form fixing tabs to allow the exchanger to be fixed to a support.

A tube-type heat exchanger generally comprises one or two headers the lower part of which comprises parallel slots to accept the ends of the tubes through which the fluid passing through the exchanger flows, said fluid emerging via the end of said tubes into an interior volume of the header.

The various components of the exchanger are generally made of metal, notably of aluminum alloy, and are assembled by brazing. To ensure high quality brazing it is necessary for the components to be assembled with one another beforehand accurately.

Thus, the assembling of a heat exchanger involves numerous prior assembly steps. In the case of a two-part header an initial assembly between the lower and upper parts of the header, a second assembly between the inlet/outlet flanges and the upper part of the header and a third assembly between the upper part and the various fixing tabs are performed in addition to the assembling of the metal tubes.

These various assembly operations require two or three steps according to the modes of assembly known to those skilled in the art; the process of assembling the exchanger is therefore complicated especially since the assembly techniques use different technologies, notably crimping, clinching or even welding.

Thus there is a first known mode of assembly in which the cover is crimped by clips provided on the lower part, the inlet/outlet flange is for its part held in position by means of a flared joint with the cover and the tab is fixed by a clip of the tab passing through the wall of the cover.

Also known is a second mode of assembly in which the cover is also crimped to the lower part using clips arranged on the lower part, while the inlet/outlet flange is crimped using a clip arranged on the cover and the fixing tab is attached to the cover using TIG welding.

Also known is a third mode of assembly in which the cover is crimped into the lower part of the header while the inlet/outlet flange and the fixing tab are secured to the cover using clinching operations.

OBJECT OF THE INVENTION

It is an object of the present invention to provide a heat exchanger in which the structure of the various components allows assembly of the lower part of the header and of the cover and at least of the inlet/outlet flange or flanges and/or of the fixing tab or tabs in a single crimping operation once the aforementioned components have been positioned relative to one another.

SUMMARY OF THE INVENTION

To this end, the present invention relates to a header as described above, in which said flange has a profile that allows longitudinal edges of the lower part, which come at least locally bent over, to be accepted at its flanks so that the flange can be crimped to said cover while at the same time the cover can be held on said lower part.

According to various embodiments:

- said flange is chosen from the following components:
  - a connecting flange defining a fluid inlet and/or outlet and able to accept a pipe,
  - a fixing tab that can be used to fix the exchanger to a support,
  - a fastening flange for attaching a cylinder designed to be in fluidic communication with the header,
- the header comprises at least two of said flanges,
- the profiles of said connecting flange or flanges, of said fixing tab or tabs and/or of said fixing flange or flanges are all identical,
- said longitudinal edges are bent over along the entire length of said header,
- the profile on one of said flanks has a groove able to accept the end of a first bent-over longitudinal edge and, on the other flank, has a protrusion able to be at least partially covered by the end of the second bent-over longitudinal edge,
- the groove and the protrusion are dimensioned so as to be compatible with a set angle of inclination between the flange and the header,
- the profile has a groove on each flank, each groove being able to accept the bent-over end of one of said longitudinal edges,
- the profile has a protrusion on each flank, each protrusion being able to accept the bent-over end of one of said longitudinal edges,
- the profile of the fixing tab or tabs comprises two ends forming wedges, each wedge matching the surface of the cover and becoming inserted just into a space formed between the cover and longitudinal walls of the header so as to be covered by said bent-over longitudinal edges,
- one of the wedges of the fixing tab is continuous along the longitudinal axis of the header and the other is interrupted at a central part, said fixing tab having, at said central part, an attachment surface that diverges from the cover.

The invention also relates to a heat exchanger comprising at least one header as mentioned above.

The invention further relates to a method of assembling such a header, in which method a step of positioning the cover of the header on the lower part thereof, a step of positioning at least one flange, and a step of bending the longitudinal edges over onto the flanks of the flange are carried out.

BRIEF DESCRIPTION OF THE FIGURES

The present invention will be better understood from reading a detailed exemplary embodiment with reference to the attached figures given by way of nonlimiting example and among which.

DETAILED DESCRIPTION OF THE INVENTION

Figure 1:
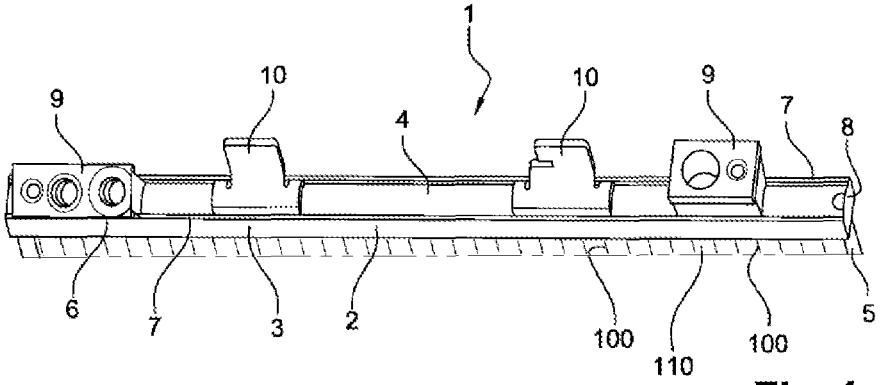
FIG. 1 is a schematic and perspective depiction of one embodiment of part of the exchanger produced according to the invention.

Reference is made to FIG. 1 which partially depicts a heat exchanger 1. It comprises a bundle of tubes 100, intended to have passing through them a fluid that exchanges heat with an air flow passing through the exchanger, these alternating with separators 110 arranged between the tubes 100 to increase the heat exchange area.

Said exchanger 1 also comprises a two-part header 2, with a lower part 3 and an upper part 4. That being the case, the terms "lower" and "upper" do not presage the orientation of the header or the orientation of the exchanger in which said header is used, it being possible for the exchanger to be oriented in such a way as to allow vertical flow of the fluid through its tubes just as it can be oriented to allow horizontal flow.

The lower part 3 forms the base of the header 2 and comprises a bottom 5, longitudinal walls 6 ending in longitudinal edges 7, for example straight longitudinal edges, and transverse walls 8.

The upper part 4 forms the cover of the header 2. The dimensions of the cover 4 are designed to allow the cover 4 to be inserted and accepted between the longitudinal walls 6 when the longitudinal edges 7 are in the straight position.

The exchanger 1 further comprises two fluid inlet/outlet flanges 9 each able to accept a fluid pipe (not depicted in the attached figures).

The exchanger 1 also comprises two other flanges forming two fixing tabs 10. These fixing tabs 10 can be used to fix the exchanger 2 to a support (not depicted in the attached figures) according to various fixing possibilities well known to those skilled in the art.

Figure 2:
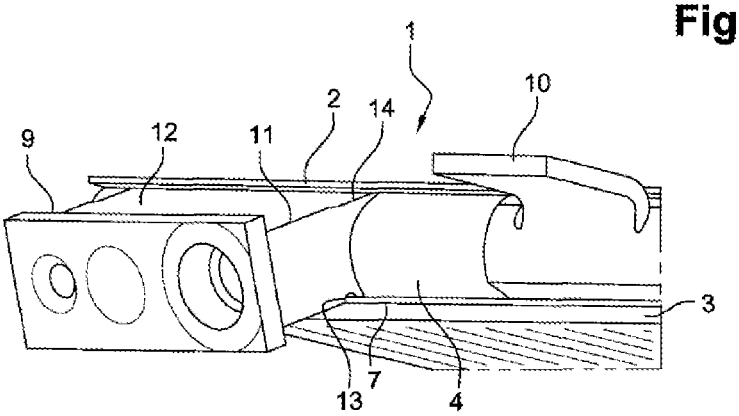
FIG. 2 is a larger scale view of a detail of FIG. 1.
Figure 3:
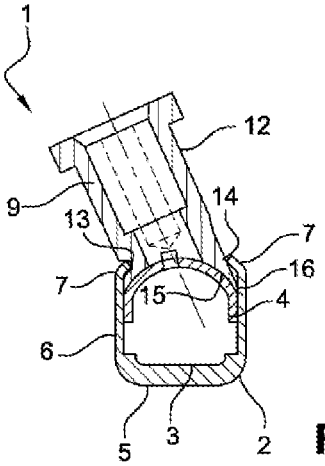
FIG. 3 is a first cross section through the embodiment of the exchanger depicted in FIG. 1.

Referring now to FIGS. 2 and 3, it may be seen that the inlet/outlet flange 9 has a particular profile 11. This profile 11 allows the longitudinal edges 7 to be accepted at the flanks 12 of the flange 9, once these longitudinal edges have been bent over.

More specifically, the profile 11 allows the inlet/outlet flange 9 to be inserted between the longitudinal edges 7 when the latter are in their straight position and allows the flange 9 to be crimped by bending said longitudinal edges 7 over onto the flanks 12.

In the exemplary embodiment of the attached figures, the profile 11 comprises a groove 13 made in one flank 12 of the flange 9 and a protrusion 14 on its other flank 12.

The protrusion 14 has an underside 15 that more or less matches the shape of the cover 4 and a lateral face 16 that comes into abutment against the inside of the longitudinal wall 6 of the lower part 3. In this way, when the longitudinal edges 7 are bent over, one of them into the groove 13 and the other onto the protrusion 14, on the one hand the flange 9 is crimped onto the cover 4 and on the other hand the cover 4 is trapped between the flange 9 and the lower part 3.

The crimping of the flange 9 therefore allows the cover 4 to be held reliably between the lower part 3 and the flange 9 in a single crimping operation.

Advantageously, the groove 13 and the protrusion 14 extend over the entire length of the flanks 12 of the flange 9.

Advantageously, the fixing tabs 10 are also designed to be secured to the cover 4 and the lower part 3 at the same time as the flange 9 crimping operation.

Figure 4:
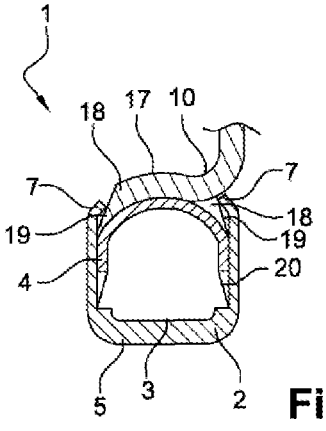
FIG. 4 is a second cross section through the embodiment of the exchanger depicted in FIG. 1.

To do this, and with reference mainly to FIG. 4, provision is made for the profile 17 of the fixing tabs 10 to comprise, for example, two ends 18 in the form of wedges 19.

Each wedge 19 matches the surface of the cover 4 and is inserted just into the space formed between the cover 4 and the longitudinal walls 6 of the lower part 3. The fixing tabs 10, the cover 4 and the lower part are secured together when the longitudinal edges 7 are bent over onto the wedges 19, preventing any movement of the tabs 10 away from the cover 4 and from the lower part 3.

It is important to point out that, advantageously, the dimensions of the groove 13 and of the protrusion 14 are calculated to be compatible with a set angle of inclination between the flange 9 and a plane of symmetry of the header 2.

The inclination is obtained by altering the length of the protrusion 14 and the depth of the groove 13. It is thus possible accurately to obtain different inclinations of the flange 9 with respect to the header 2. FIG. 3 thus shows one possible example of the inclination between the flange 9 and the header 2, the inclination being controlled by the dimensions of the groove 13 and of the protrusion 14.

Likewise, the orientation of the fixing tab 10 with respect to the header 2 is controlled by altering the length of the wedges 19. In the embodiment of the attached figures and as is more particularly visible in FIG. 4, the wedges 19 are substantially identical, although in order to obtain different inclinations, it would be possible to provide wedges 19 of non-identical lengths.

Figure 5:
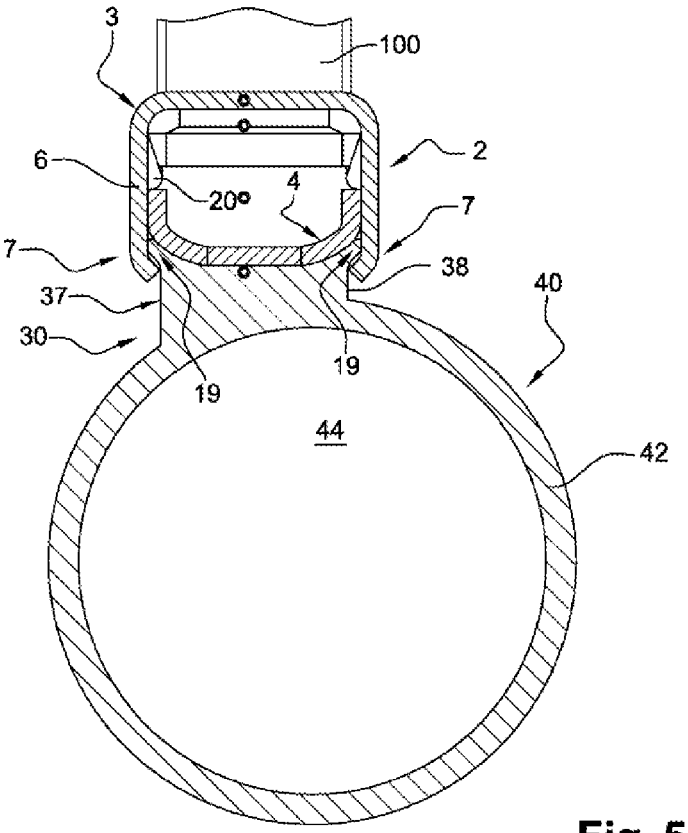
FIG. 5 is a cross section through an alternative form of embodiment, the section being taken at the same angle as in FIGS. 3 and 4.

As illustrated in FIG. 5, the exchanger according to the invention can also comprise a cylinder 40 designed to be in fluidic communication with the header. In a way known to those skilled in the art, such a cylinder is oriented parallel to the header 2 and has a wall 42 defining an interior volume 44. Such a cylinder is notably used to define a fluid storage volume and/or to facilitate separation of phases when associated with a condenser. Said cylinder may also be fitted with a filter and/or with a desiccant cartridge, neither of which items has been depicted.

Said header may then be equipped with a flange, as mentioned above, this time defining an attachment flange 30 for the cylinder 40, said attachment flange 30 possibly being provided as a material continuity of the cylinder 40. In the example depicted, the fixing flange 30 is of the type having protrusions 14 or wedges 19.

It is also important to emphasize that in order to position the cover 4 in the lower part 3 when bending over the longitudinal edges, a local deformation or an additional thickness is provided at the longitudinal walls 6 and/or transverse walls 8. This local deformation or additional thickness constitutes an end stop 20 preventing the cover 4 from dropping into the bottom of the lower part 3 through forcing on the longitudinal wall 6.

That being the case, it should be noted that, in the known way, the header 2 may comprise partitions dividing its internal volume into several parts, each one connected to a given number of exchanger tubes, defining fluid circulation passes having the effect of allowing the fluid to circulate alternately in directions that alternate from one pass to the next.

In such a case and according to an alternative form of embodiment that has not been depicted, the cover 4 may rest against the lower part 3 via said partitions and/or transverse walls 8 as an alternative and/or in addition to resting via the end stops 20.

It may thus be seen that the proposed structure allows the various types of flange 9, 10, 30 provided on the header 2 to be crimped simultaneously while at the same time holding the cover 4 in place.

More specifically, the bent-over edges 7 will be present, for example, at said flanges at least in the region of at least one of said flanges, and it is the crimping of said flange or flanges by the bent-over edges 7 that will hold the cover 4 in position on the lower part 3. Bent-over edges 7 may also be provided beyond said flanges in order to hold the cover in position not only by the flanges but also by the bent-over parts which are now in direct contact with said cover, and which are provided beyond the flanges.

The method of assembling the exchanger involves carrying out a first step of positioning the cover 4 of the header 2. To do that, the cover 4 is inserted in the lower part 3 as far as the end stop 20. Next, the various inlet/outlet flanges 9 are positioned on the cover 4. This positioning of the flange 9 is easy because all that is required is for the flanges 9 to be moved vertically until they come into contact with the cover 4 causing the openings made in the cover 4 to coincide with those made in the flanges 9.

In the embodiment illustrated, the exchanger 1 comprises fixing tabs 10 at the header 2, the fixing tabs 10 are therefore also positioned. However, this step is naturally omitted when the fixing tabs 10 are not located on the cover of the header 2 or even in a down-graded embodiment of the invention in which the fixing tabs 10 are fixed to the cover 4 in the conventional way, notably by welding or clipping.

The method of assembling the exchanger 1 then consists in carrying out a step of bending the longitudinal edges 7 over. This bending-over step allows the end of the longitudinal edges 7 to be positioned in the grooves 13 and on the protrusions 14 of the flanges 9 as well as, where appropriate, on the wedges 19.

When the longitudinal edges 7 are placed on the flanks 12 of the flanges 9 and cover the wedges 19 of the fixing tabs 10, the flanges 9 and the tabs 10 are crimped trapping the cover 4 of the header 2. Assembly of the various components 3, 4, 9 and 10 is therefore carried out simultaneously in one single crimping operation.

Other features of the invention could also have been conceived of without thereby departing from the scope of the invention defined in the following claims.

Notably and by way of example, in other embodiments the profile 11 of the flanges 9 could differ and for example each flank 12 could comprise a protrusion 14 for crimping or alternatively each flank 12 could comprise a groove 13 to accept the bent-over end of the longitudinal edge 7.

In another embodiment, the grooves 13 and the protrusions 14 of the flanges 9 and/or the wedges 19 of the tabs 10 extend only partially along the length of the components 9 and 10.

Instead of being straight, the longitudinal edges 7 could be in the form of crimping tabs distributed along the flanks, for example uniformly and/or so as to coincide with the locations of the grooves, of the protrusions and/or of the wedges of the flanges, assembly being performed after said crimping tabs have been bent over.

The invention claimed is:

1. A header for a heat exchanger, said header comprising a lower part having a bottom and two longitudinal walls extending from said bottom with longitudinal edges of the two longitudinal walls extending an entire length of said lower part, an upper part having a cover with a top and two longitudinal walls extending from said top toward said bottom of said lower part, where each longitudinal wall of the top of the upper part is parallel to and contacts a respective longitudinal wall of said bottom of said lower part and at least one flange separate from said cover, wherein said at least one flange has a profile having a first side with a first end and a second side with a second end, where the first end defines a first wedge and the second end defines a second wedge, each wedge matching a surface of said top of said cover and being inserted into a space formed between the surface of said top of said cover and a respective one of said longitudinal walls of said lower part, such that one of the longitudinal edges of the lower part is bent over the first wedge and another of the longitudinal edges of the lower part is bent over the second wedge, and such that said longitudinal edges are spaced from said top of said cover and do not contact said top of said cover, wherein said profile has a groove on the first side extending longitudinally in a direction parallel to said longitudinal walls of the lower part that receives an end of the one of the longitudinal edges of the lower part, wherein said profile has a protrusion on the second side that is in contact with an end of the another of the longitudinal edges of the lower part, and wherein the end of the another of the longitudinal ends of the lower part is not received within a groove.

2. The header as claimed in claim 1, in which said at least one flange is chosen from the following components:

a connecting flange defining a fluid inlet and/or outlet and able to accept a pipe, a fixing tab to fix the heat exchanger to a support.

3. The header as claimed in claim 2, in which one wedge of said fixing tab is continuous in the direction of a longitudinal axis of said header and another wedge of said fixing tab is interrupted at a central part, said fixing tab having, at said central part, an attachment surface that diverges from said cover.

4. The header as claimed in claim 2, in which said longitudinal edges of the lower part are bent over along an entire length of said header.

5. The header as claimed in claim 1, in which said longitudinal edges of the lower part are bent over along an entire length of said header.

6. The header as claimed in claim 1, in which said groove and said protrusion are dimensioned so as to be compatible with a set angle of inclination between said flange and said header.

7. A heat exchanger comprising the header as claimed in claim 1.

8. A method of assembling the header as claimed in claim 1, said method comprising:

positioning the cover of the header on the lower part thereof, positioning the at least one flange, and bending the longitudinal edges over onto the sides of the flange.

* * * * *